US010101130B2

(12) United States Patent
Citterio et al.

(10) Patent No.: US 10,101,130 B2
(45) Date of Patent: Oct. 16, 2018

(54) STRUCTURE WITH BREATHABLE FABRIC FOR THE PRODUCTION OF BALLISTIC AND STAB-RESISTANT PROTECTIONS

(71) Applicant: Società Per Azioni Fratelli Citterio, Monza (IT)

(72) Inventors: Giorgio Citterio, Monza (IT); Filippo Citterio, Monza (IT)

(73) Assignee: Società Per Azioni Fratelli Citterio, Monza (IT)

( * ) Notice: Subject to any disclaimer, the term of this patent is extended or adjusted under 35 U.S.C. 154(b) by 0 days.

(21) Appl. No.: 15/567,755

(22) PCT Filed: Feb. 29, 2016

(86) PCT No.: PCT/EP2016/054252
§ 371 (c)(1),
(2) Date: Oct. 19, 2017

(87) PCT Pub. No.: WO2016/169681
PCT Pub. Date: Oct. 27, 2016

(65) Prior Publication Data

US 2018/0087878 A1 Mar. 29, 2018

(30) Foreign Application Priority Data

Apr. 21, 2015 (IT) ..... MI2015A0574

(51) Int. Cl.
*F41H 5/04* (2006.01)

(52) U.S. Cl.
CPC ..... *F41H 5/0478* (2013.01)

(58) Field of Classification Search
CPC ..... F41H 5/04; F41H 5/0478
USPC ..... 89/36.02
See application file for complete search history.

(56) References Cited

U.S. PATENT DOCUMENTS 4,613,535 A * 9/1986 Harpell ..... C08J 5/24 2/2.5
5,376,443 A * 12/1994 Sijan ..... B32B 17/10018 244/121
6,133,169 A * 10/2000 Chiou ..... A41D 31/0061 428/911
6,737,368 B2 * 5/2004 Chiou ..... B32B 5/26 428/902
7,340,779 B2 * 3/2008 Chiou ..... B32B 5/26 2/2.5
8,067,317 B2 * 11/2011 Hand ..... B32B 5/26 428/152
8,450,222 B2 * 5/2013 Pritchard ..... B32B 5/26 427/389.9
9,131,790 B2 * 9/2015 Agarwal ..... A47G 9/0238
2005/0130521 A1 * 6/2005 Wyner ..... A41D 31/0027 442/59
2005/0257678 A1 * 11/2005 Camp ..... F41C 33/06 89/36.07
2010/0043630 A1 * 2/2010 Sayre ..... F41H 5/0421 89/36.02
2010/0154622 A1 * 6/2010 Zachau ..... B32B 17/10036 89/36.02
2012/0291621 A1 * 11/2012 Sayre ..... F41H 5/0421 89/36.02
2012/0297964 A1 * 11/2012 Carberry ..... F41H 5/0407 89/36.02
2013/0180393 A1 * 7/2013 Kienzle ..... F41H 5/0414 89/36.02
2013/0205982 A1 * 8/2013 Walter ..... F41H 7/042 89/36.02
2015/0135937 A1 * 5/2015 Bader ..... B32B 5/26 89/36.02
2015/0251392 A1 * 9/2015 Dorschu ..... F41H 5/0407 89/36.02
2015/0323292 A1 * 11/2015 Strauss ..... F41H 5/0485 89/36.02
2016/0178328 A1 * 6/2016 Citterio ..... F41H 5/0485 89/36.02
2017/0175303 A1 * 6/2017 Agarwal ..... D03D 1/0017
2017/0314169 A1 * 11/2017 Agarwal ..... D03D 1/0017

FOREIGN PATENT DOCUMENTS

EP 1102958 B1 10/2002
EP 1595105 B1 8/2007
IT MI20030295 A1 8/2004
WO WO-2004074761 A1 9/2004
WO WO-2012024532 A1 2/2012
WO WO-2012063271 A2 5/2012
WO WO-2014145681 A1 9/2014

OTHER PUBLICATIONS

Fiocco, Marco, "International Search Report," prepared for PCT/EP2016/054252, dated May 10, 2016, five pages.
U.S. Department of Justice, National Institute of Justice, "Stab Resistance of Personal Body Armor," NIJ Standard 0115.00, Sep. 2000, pp. 1-36.
U.S. Department of Justice, National Institute of Justice, "Ballistic Resistance of Personal Body Armor," NIJ Standard 0101.04, Jun. 2001, pp. 1-45.
Italian National Unification Body, "Determination of the Abrasion Resistance of Fabrics by the Martindale Method, Martindale Abrasion Testing Apparatus," European Standard EN ISO 12947-1, Sep. 2000, pp. 1-18.
Italian National Unification Body, "Determination of the Abrasion Resistance of Fabrics by the Martindale Method, Determination of Mass Loss" European Standard EN ISO 12947-3, Sep. 2000, pp. 1-12.

(Continued)

*Primary Examiner* — Joshua E Freeman
(74) *Attorney, Agent, or Firm* — Winstead PC

(57) ABSTRACT

The present invention relates to a flexible, breathable, anti-penetration fabric, made of antiballistic yarns, partially o wholly impregnated with one or more polymer resins, having a positive coefficient of expansion and hardness greater than 75 Sh D. The structure obtained by the process according to the present invention provides transpiration qualities which make the protections realized with this structure particularly comfortable.

19 Claims, No Drawings

(56) References Cited

OTHER PUBLICATIONS

Italian National Unification Body, "Determination of Permeability of Fabrics to Air," European Standard EN ISO 9237, Jun. 1997, pp. 1-10.

* cited by examiner

STRUCTURE WITH BREATHABLE FABRIC FOR THE PRODUCTION OF BALLISTIC AND STAB-RESISTANT PROTECTIONS

TECHNICAL FIELD

The present invention relates to a flexible, breathable, anti-penetration fabric, made of antiballistic yarns combined with one or more polymer resins.

TECHNICAL BACKGROUND

Protections against blades, awls and other cutting tools are becoming an almost absolute necessity, especially for Security Forces, since more and more often these Forces have to face a new type of crime that uses such instruments, as they are easily available and concealable.

This need cannot leave aside also the protections against threats represented by bullet firing or fragments coming from explosions of metallic objects.

The protection mechanism against the so-called cold weapons, that is knives, etc., as described above, is completely different from the protection mechanism against bullets and fragments.

In order to obtain an efficient protection against both threats, the used protections generally combine at least two separate types thereof, which are obtained with predominantly textile structures.

There are a number of known solutions in the specific field of protections against penetration of cold weapons.

The U.S. Pat. No. 6,737,368 claims a structure composed of at least three separate elements for the protection against blades, awls and bullets at the same time, in which at least one element is impregnated with thermoplastic or thermosetting resins.

The U.S. Pat. No. 6,133,169 claims a structure for the protection against blades and awls composed of a metallic, flexible structure and a plurality of fabrics obtained otherwise.

The U.S. Pat. No. 7,340,779 claims a textile structure able to protect only against awls.

The U.S. Pat. No. 8,067,317 claims a structure able to protect against knives and bullets, but not against awls.

The U.S. Pat. No. 8,450,222 claims a textile structure covered at least on one side with a film of ethylene acrylic acid copolymer having determined hardness and tensile strength characteristics.

The Patent EP 1102958 B1 claims a structure realized with two layers of fabrics joined together with a polycarbonate film aimed at the protection against only cold weapons.

Other possible solutions, known to those skilled in the field, include one or more of the following types of fabrics: high density fabrics; high density fabrics subsequently further densified; covered with abrasive particles; combinations of steel meshes with laminated and not laminated fabrics.

In order to obtain protections against bullets, the resins used to reinforce the structure are selected among those having high elongation at break, low tenacity and low hardness, so that, for example, the Patent EP1595105 (which claims Italian priority of Patent Application No. IT2003MI00295 filed on 19 Feb. 2003) owned by F. Ili Citterio describes a structure impregnated with viscoelastic resin, which remains liquid even after the solvent has evaporated, therefore even softer than at Sh D 00 value.

The recent anti bullet structures are made of ballistic yarns positioned parallel without being interwoven, said structures being called unidirectional or semi-unidirectional. Therefore, due to the lack of interweaving and because of the soft resins used, such structure is completely unsuitable against cold weapons.

Each of the above described solutions has obvious disadvantages, for example, they are either completely impermeable to the air, and consequently not breathable, or they do not protect against the three threats at the same time—knife, awl, bullet—and they must be hybridized, which makes them heavy.

OBJECT OF THE INVENTION

The main object of the present invention is to propose an element of ballistic protection and against cutting weapons which reduces the disadvantages of the prior art.

SUMMARY OF THE INVENTION

This result has been obtained, according to the present invention, by means of a structure including at least a textile element, whose fibers have a negative axial Coefficient of Thermal Expansion (CTE), the textile element being impregnated with at least one polymer resin having a positive Coefficient of Thermal Expansion (CTE), hardness greater than 75 Shore D and a cohesive strength such that, once dried, the polymer resin becomes crumbly. In a preferred embodiment of the present invention the polymer resin has hardness greater than 80 Shore D. Preferably the at least one resin includes at least one resin selected from: natural or synthetic resins, such as rosin, epoxy phenolic, polyamide, acrylic, polyurethane resins, PVC, PVA. The at least one resin will preferably have a not determinable cohesive strength such that, once dried, it can be easily reduced to powder even only with fingers. The at least one polymer resin preferably includes a copolymer Butyl Acrylate-Methyl Methacrylate. In a preferred embodiment the at least one polymer resin includes 5-cloro-2-metil-2H-isotiazol-3-one or 2-metil-2H-isotiazol-3-one or a combination of the two, mixed together. Preferably, the at least one resin comprises acrylic resin Acrilem 7105.

The structure of the present invention provides a flexible and breathable anti bullet-cut-awl protection, in which the presence of holes and a polymeric deposit constituted by micro-fractures provide breathability, protection against blades and pointed objects all together, without giving up a valid protection against bullets and without the need to hybridize.

In a preferred embodiment of the present invention, the CTE of the fibers of the textile element is within the range between $-20\times10^{-6}/°$ C. and 0/° C., preferably in the range of $-20\times10^{-6}$ to $-0,1\times10^{-6}$ per degree centigrade, while the CTE of at least one resin is greater than $10\times10^{-6}/°$ C. In the structure according to a preferred embodiment of the present invention, the polymer layer after the treatment presents a structure with discontinuities which let air pass through. Such discontinuities can be micropores having dimensions in the range of 10 to 300 μm.

In an optional embodiment, the at least one resin comprises at least a first and a second resin, mixed with the first resin, the second resin having hardness greater than 75 Shore D, elongation greater than 300%, the percentage of weight of the second resin not exceeding 10% of the total resin. In an optional embodiment, particles having a size between 2 and 200 nm are dispersed in the at least one resin. The particles can be ceramic or not, also in the form of nanoparticles, and can be composed, for example, of one or more of the following materials: $TiO_2$, $Al_2O_3$, Sic, $Si_3N_4$, carbon.

The textile element preferably comprises fibers of one of the following groups: aramid, co-polyaramid, polyurethane, polybenzo-oxazole, polyethylenes, carbon yarns or glass.

According to another aspect of the present invention, a production process is provided, which facilitates the adhesion matrix/fiber; the process according to an embodiment of the present invention includes the following steps:

application of resin to the textile element according to one of the many ones available in the state of the art; the characteristics of the fabric and resin are those described above;

drying the textile element with the resin joined thereto;

pressing at a temperature $T_P$ based on the characteristics of the used fabric and resin. The temperature is selected so as to respect the following relation:

$$|CTE_f*(T_p-T_a)|+|CTE_r*(T_s-T_a)|>300\times10^{-6}$$

wherein $CTE_f$ is the axial Coefficient of expansion of the fiber of the textile element;

$T_p$ is the pressing temperature;

$T_a$ is the surrounding environment temperature;

$CTE_r$ is the Coefficient of expansion of the resin.

As indicated above, the CTE of the fabric is negative, while the CTE of the resin is positive.

The temperature $T_p$ is preferably in the range of 20 to 200° C., the pressure is in the range of 5 to 200 bar and the pressing time is greater than 5 s.

The present invention makes it possible to obtain an element of ballistic protection, which is particularly effective both against bullets fired by a gun or rifle and against the attack with a cutting weapon and which at the same time has breathable characteristics.

It has been surprisingly found that the use of extremely hard polymer resins, having the hardness value greater than 75 Sh D (or even greater than 80 ShD) whose fragility does not even allow an assessment of the cohesion value with the positive coefficient of expansion in combination with weft/warp fabrics obtained with yarns having negative axial coefficient of expansion, allows all the required characteristics to be obtained, in particular: air permeability and greater flexibility in case these resins, after impregnation and possible elimination of the solvent, are subjected to a thermal cycle with possible application of pressure.

The particular fragility of the resins, together with the difference of the coefficients of expansion resin-yarn, during the cooling step of the fabric undergoing the thermal cycle, allow formation of micro-fractures, therefore discontinuities which increase the flexibility, allowing calibrated passage of the air without jeopardizing the performance with respect to the cold weapons and bullets. This occurs since the hardness of the resin acts effectively against the penetration of the cold weapons and the micro discontinuities allow the yarns of the fabrics to elongate so as to dynamically absorb the energy of the bullet impact.

DETAILED DESCRIPTION

These and further advantages, objects and characteristics of the present invention will be better understood by those skilled in the art from the following description, with reference to the illustrative embodiments having purely illustrative character, and not intended as limiting.

Ballistic yarns with negative axial coefficient of expansion have been used for the production of fabrics resistant to cold weapons and bullets, which are breathable and flexible. The negative coefficient of expansion means that the length of the yarn decreases with the increase of the temperature.

Such yarns useful for the object of the present invention include aramid, co-polyaramid, polyurethane, polybenzo-oxazole, polyethylenes yarns, yarns of carbon or glass. The tenacity of such yarns must be greater than 10 gr/dtex, the modulus greater than 300 Gpa and the elongation to rupture greater than 1%.

The negative axial coefficient of expansion of such yarns, useful for the object of the present invention, must be negative and greater than $-20\times10^{-6}$/° C., preferably in the range of $-20\times10^{-6}$ to $-0$, $1\times10^{-6}$ per degree centigrade.

The indicated yarns are woven to obtain a stable structure. The characterization of such structures is indicated as "weave". Therefore, a number of weaves are known that include plain weaves, double weaves, twills, satins, etc.

Weaves which are particularly useful for the object of the present invention are represented by fabrics having plain weave structure, where each weft thread crosses each warp thread.

The textile structure can also be composed of yarns deriving from different polymers combined together and having a different size (count). In any case, at least 30% of such yarns must have a negative axial coefficient of expansion.

The count of yarns is in the range of 100 to 4500 dtex, preferably of 200 to 3360 dtex.

The weight of the fabrics, before impregnation, is in the range of 80 gr/m$^2$ to 1000 gr/m$^2$, preferably 120 to 500 gr/m$^2$.

The yarn can be pre-treated before the weaving or the fabric can be subjected, before impregnation, to the treatments that activate polarly the surface; this applies especially to fabrics based on fibers of ultra high molecular weight polyethylene, for example greater than 1,000,000. The yarns can be twisted with twisting turns comprised between 10 turns per meter and 200 turns per meter. The used yarns can also have a discontinuous form.

The fabric, before being impregnated with the polymer resin, can be treated with other resins (for example, silicones or fluorocarbons) in order to modify adhesion of the polymer/s, subject of the present invention, to the fibers of the yarns that compose the fabric.

Application of the resin (or resins) to the fabric, according to an embodiment of the present invention, is carried out by technologies which are well known to those skilled in the art, for example, by doctoring, spraying, immersion; if the resin is carried by a solvent, afterwards the solvent is made evaporate completely. If the resin is in powder form, the drying step is not necessary. The fabric can also be partially impregnated or impregnated on only one surface.

Advantageously, after the impregnation step, the fabric is subjected to a pressing step, with the pressure variable from 1 to 200 bar and a temperature, which is selected in such a way as to respect the following relation $$|CTE_f\times(T_p-T_a)|+|CTE_r\times(T_p-T_a)|>300\times10^{-6}$$

where $CTE_f$ is the (negative) axial coefficient of expansion of the yarn of the textile element $T_p$=pressing temperature $T_a$=temperature of the surrounding environment, with which the yarn or the resin are balanced $CTE_r$ is the coefficient of expansion of the resin.

The polymer or the polymers that impregnate the fabrics must have a positive coefficient of expansion greater than $10\times10^{-6}\times$C°. These polymers include, for example, natural or synthetic resins, such as rosin, epoxy, phenolic, polyamide, acrylic, polyurethane resins, PVC, PVA. The hardness of such resins must not be lower than 75 Sh D and the elongations must be smaller than 5%.

In a preferred embodiment, the used resin can relate to a solution of a thermoplastic acrylic polymer of the 7105 type (ACRILEM 7105), produced by Icap Sira, for which it is not possible to realize a structure that can be consolidated by itself due to the fragility of the resin. The capacity of cohesion is null, so that, once dried, the product can be easily reduced to powder only with fingers. ACRILEM 7105 resin contains a copolymer Butyl Acrylate-Methyl methacrylate; more specifically it includes the following components mixed together: 5-cloro-2-metil-2H-isotiazol-3-one [EC no. 247-500-7] and 2-metil-2H-isotiazol-3-one [EC no. 220-239-6].

Another polymer (B) can be added to this polymer (A) in as much as 10% by weight with respect to the resin A, as a modifier of the polymer adhesion to the fibers of the yarns.

The polymers based on elastomeric polyurethane, polybutene, polyisobutene, acrylic, meta acrylic polyvinyl butyral resins, and the like are particularly useful for the purpose of the present invention.

Respecting the above mentioned rules, the polymer resins A or A+B can include ceramic or non ceramic particles, also in the form of nanoparticles, having dimensions in the range of 2 to 200 nm, for example, particles based on $TiO_2$, $Al_2O_3$, Sic, $Si_3N_4$, carbon. These particles can increase the friction value of the blade or bullet, thus improving the performance of the product.

The amounts of such resin/s to be applied are in the range of 10 gr/m$^2$ to 200 gr/m$^2$ of dry product on the fabric. In particular, in percentage terms, the amounts of dry resin on the fabric are in the range of 10% to 80% and preferably in the range of 20% to 60%.

The formation of gaps due to the rigidity of the resin and the difference of the absolute coefficient of expansion between the resins and the yarn of the fabric allows to obtain gaps both in the form of small holes and cracked areas. The bigger the difference between the coefficient of expansion of the yarn and the coefficient of expansion of the resin, the bigger such gaps and the higher molding temperature.

The gaps obtained with this process vary from 30 to 300 micron. In particular, the acrylic polymer resin 7105, shows an absolute resistance to the extreme environmental humidity conditions, as it can be deduced from the tests described below: a series of fabrics called Style 640 made of Aramide Kevlar® yarns produced by DuPont®, weighing 165 gr/m$^2$ and obtained with fibers of 670 dtex, have been impregnated with about 70 gr/m$^2$ of the resin 7105. After drying and molding at 125° C., a series of specimens have been subjected to an artificial conditioning at a temperature of 60° C. and relative humidity of 90%.

A sufficient quantity of such fabrics have been taken at intervals of 250 hours. The same fabrics re-conditioned at 20° C. with humidity at 60% have been subjected to the knife action according to the American rule 01 0115NIJ using the blade P1B and awl as indicated. All the tests have been carried out with a new blade for each impact with energy of 50 Joules and with new awls for each impact with energy of 50 Joules.

Samples Typology

The samples have been produced according to OPR87/C/2014.

Style 640 scoured fabric impregnated with resin 65 g/m$^2$ and molded.

Packages of 30 layers for a weight of about 6.4 kg/m$^2$

Ageing Process

Ageing in a temperature chamber at 90% U.R. and 60° C. for 250, 500, 750, 1000 hours.

At the end of each ageing period, the samples are dried and conditioned at 20° C. and 60% U.R. for 24 hours.

Test Procedure

Test according to HOSDB, blade P1B.

Each package has been subjected to two series of 3 stabs:

the first one at 50 Joule the second one at 36 Joule

Distance between the stabs shots: 60 mm

The blade was changed every 3 stabs.

Results

| Package | Perforation 50 Joule - mm | | | Perforation 36 Joule mm | | |
|---|---|---|---|---|---|---|
| 0 hours | 11 | 9 | 7 | 1 | 0 | 0 |
| 0 hours | 3 | 3 | 3 | 0 | 0 | 0 |
| 250 hours | 6 | 6 | 4 | 0 | 0 | 0 |
| 250 hours | 11 | 6 | 4 | 0 | 0 | 0 |
| 500 hours | 12 | 6 | 5 | 0 | 0 | 0 |
| 500 hours | 10 | 6 | 5 | 0 | 0 | 0 |
| 750 hours | 4 | 5 | 5 | 0 | 0 | 0 |
| 750 hours | 8 | 4 | 3 | 1 | 0 | 0 |
| 1000 hours | 3 | 9 | 8 | 0 | 0 | 0 |
| 1000 hours | 4 | 8 | 6 | 0 | 0.5 | 0.5 |

For the sake of completeness, the packages aged 0 hours, 750 hours and 1000 hours have been tested with 9 mm Remington.

The results are as follows:

| | V50 9 mm Remington 30 layers with foam m/s | |
|---|---|---|
| Package | A | B |
| 0 hours | 408 | 410 |
| 750 hours | 378 | |
| 1000 hours | 376 | 376 |

For the awl=0.

Consequently, it is to be noted that the stability of the resin is optimal even after 1000 hours of conditioning.

Another series of composed laminated fabrics obtained according to the present invention have been compared with another series of fabrics without resin, so as to verify their wear resistance. The used system complies with regulations UNI EN ISO 12947-1:2000, UNI 12947-3:2000 (Martindale) to verify whether the resin fragility could jeopardize the mechanical characteristics. After 20,000 cycles the fabric in its unaltered state has lost 15.8 mg of its weight, the laminated fabric has lost 15.4 mg of its weight, which is a slightly better result with respect to the fabric in its unaltered state.

Another series of resin-added and laminated fabrics have been then subjected to the air permeability tests according to UNI EN ISO 9237:1997; the applied vacuum is equal to 200 Pa. The result indicates an average permeability of 1.55 mm/s, which confirms that the required targets have been met also in breathability terms.

In another preferred embodiment, 5% of an elastomeric polymer of the Kraton 3301 type (type B Resin) has been added to the resin 7105.

Using the same production process proposed by the present invention, 32 overlaid layers of 40 cm×40 cm have been produced. These layers of fabrics of aramid fiber of the DuPont® K29 type Kevlar® weighing 190 gr/m$^2$, added with resin with 80 gr/m$^2$ of resins A+B to check their contemporaneous resistance to knife, bullet and awl according to the regulations NIJ 01 004 Level IIIA and NIJ 01 0115 Level 50 Joules. The regulation requirements have been easily met and the air permeability resulted to be 2.05 mm/s.

It is understood that, within the scope of the present invention, the term "polymer" refers to a polymeric material, as well as to natural or synthetic resins and their mixtures. It is also understood that the term "fiber" refers to elongated bodies, whose longitudinal dimension is much longer than the transversal dimension.

In practice, in any case, the implementation details can vary in the same way for what refers to the singular constructive elements, as described and illustrated, as well as to the nature of the indicated materials, without departing from the adopted solution concept and consequently, remaining within the protection provided by the present patent.

The invention claimed is:

1. A structure for the production of stab-resistant ballistic protection, the structure comprising:

at least one textile element including fibers having a negative axial Coefficient of Thermal Expansion (CTE); and wherein the textile element is impregnated with at least one polymer resin having a positive Coefficient of Thermal Expansion (CTE), hardness greater than 75 Shore D, and a cohesive strength such that, once dry, the polymer resin becomes crumbly.

2. The structure according to claim 1, wherein the at least one polymer resin has hardness greater than 80 Shore D.

3. The structure according to claim 1, wherein the at least one polymer resin comprises at least one resin selected from: natural or synthetic resins rosin type, epoxy, phenolic, polyamide, acrylic, polyurethane, PVC, PVA.

4. The structure according to claim 1, wherein the at least one polymer resin includes a copolymer Butyl Acrylate-Methyl Methacrylate.

5. The structure according to claim 1, wherein the at least one polymer resin includes 5-cloro-2-metil-2H-isotiazol-3-one.

6. The structure according to claim 1, wherein the at least one resin includes 2-metil-2H-isotiazol-3-one.

7. The structure according to claim 6, when depending on claim 5 wherein the components 5-cloro-2-metil-2H-isotiazol-3-one and 2-metil-2H-isotiazol-3-one are mixed together.

8. The structure according to claim 7, wherein the at least one polymer resin includes acrylic resin Acrilem 7105.

9. The structure according to claim 1, wherein the axial CTE of the fibers of the textile element is between $-20\times10^{-6}$/° C. and 0/° C.

10. The structure according to claim 1, wherein the CTE of the at least one polymer resin is greater than $10\times10^{-6}$/° C.

11. The structure according to claim 1, wherein the polymer layer once dry has a structure with gaps which let air pass through.

12. The structure according to claim 11, wherein the gaps include micropores having a size between 10 and 300 μm.

13. The structure according to claim 1, wherein the at least one polymer resin comprises at least a first and a second resin, mixed with the first resin, the second resin having hardness lower than 75 Shore D, elongation greater than 300% , and wherein the percentage of weight of the second resin does not exceed 10% of the total resin.

14. The structure according to claim 1, wherein particles having a size between 2 and 200 nm are dispersed in the at least one polymer resin.

15. The structure according to claim 14, wherein the particles are composed of at least one of the following materials: $TiO_2$, $Al_2O_3$, Sic, $Si_3N_4$, carbon.

16. The structure according to claim 1, wherein the textile element comprises fibers of at least one of the following groups: aramid, co-poliaramid, polyurethane, polybenzo-oxazole, polyethylenes, carbon yarns or glass.

17. A production process for making a structure according to claim 1, the process comprising the following steps:

applying at least one polymeric resin in liquid form to the at least one textile element;

drying of the polymer resin;

pressing the structure, in which the step of pressing is carried out at a temperature $T_p$ such that the following condition is respected:

$$|CTE_f*(T_p-T_a)|+|CTE_r*(T_p-T_a)|>300\times10^{-6}$$

wherein $CTE_f$ is the (negative) CTE of the fibers of the textile element;

$T_a$ is the ambient temperature;

$CTE_r$ is the (positive) CTE of the polymer resin.

18. The production process according to claim 17, wherein the temperature $T_p$ is between 20 and 200° C., the pressure is between 5 and 200 bar and the pressing time is longer than 5s.

19. A ballistic protective article comprising a structure according to claim 1.

* * * * *